US005327587A

United States Patent [19]

Hurwitz

[11] Patent Number: 5,327,587

[45] Date of Patent: Jul. 12, 1994

[54] ILLUMINATED SAFETY HELMET

[76] Inventor: Marni Hurwitz, P.O. Box 502, Mountain Side Rd., Mendham, N.J. 07945

[21] Appl. No.: 67,061

[22] Filed: May 26, 1993

[51] Int. Cl.[5] ..... A42B 3/02; F21L 15/14

[52] U.S. Cl. ..... 2/422; 362/72; 362/105

[58] Field of Search ..... 362/105, 106, 103, 72; 2/422, 424

[56] References Cited

U.S. PATENT DOCUMENTS 4,891,736 1/1990 Gouda ..... 362/72 X
5,040,099 8/1991 Harris ..... 362/105 X
5,151,678 9/1992 Veltri et al. ..... 362/103 X

FOREIGN PATENT DOCUMENTS 0166534 1/1986 European Pat. Off. ..... 362/105
0912127 5/1954 Fed. Rep. of Germany ..... 362/106

*Primary Examiner*—Peter Nerbun

[57] ABSTRACT

An illuminated safety helmet including at least one electroluminescent strip permanently adhered to a helmet shell which is powered by a power unit arranged on the helmet shell, where the power unit includes a rechargeable battery. Power is supplied to the electroluminescent strips when an ON/OFF switch is turned ON.

1 Claim, 4 Drawing Sheets

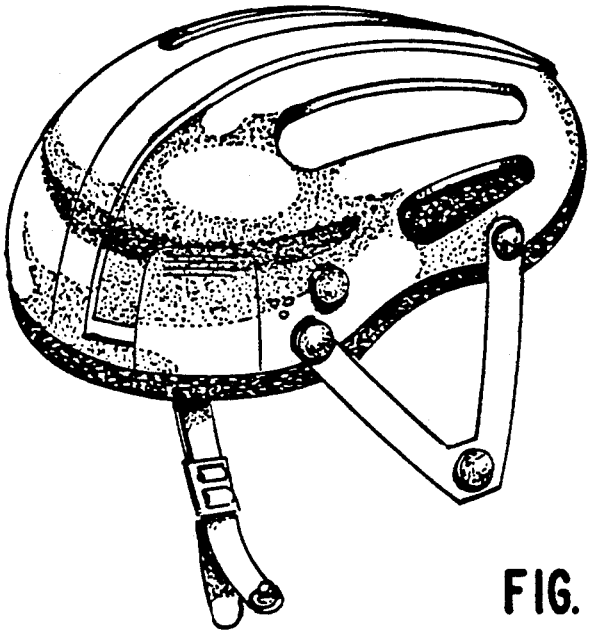
FIG. 1
FIG. 2
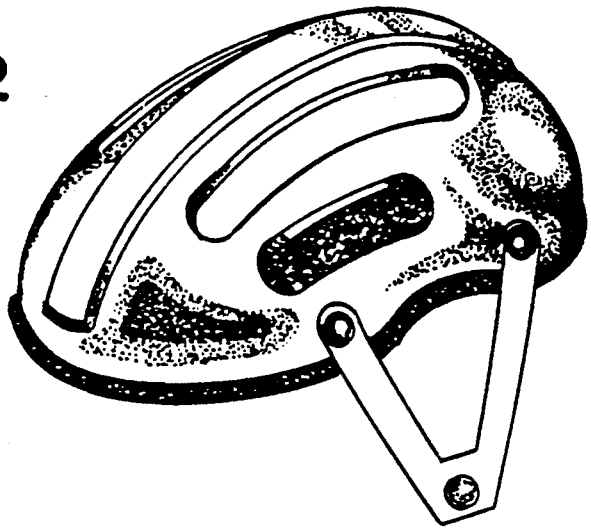

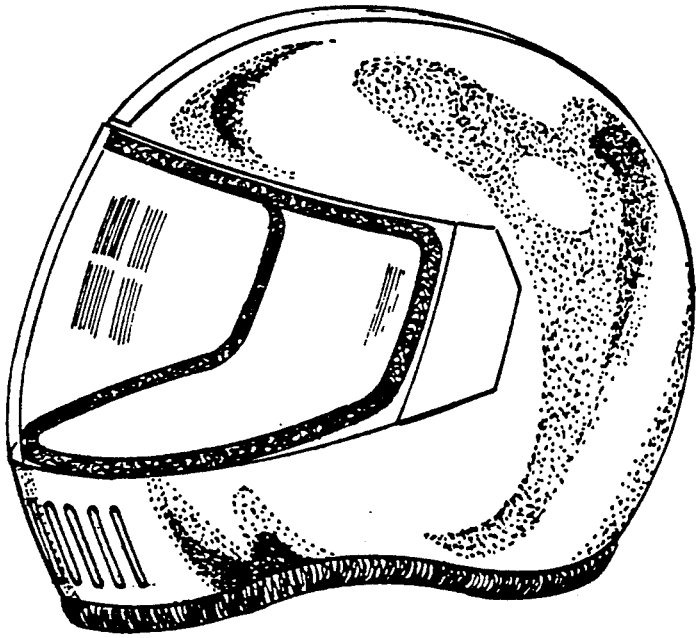
FIG. 4
FIG. 5
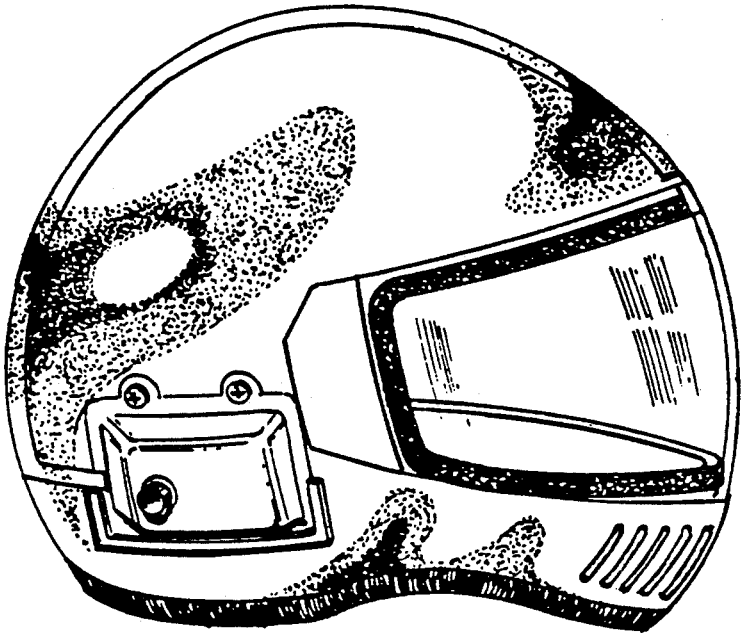

ILLUMINATED SAFETY HELMET

BACKGROUND OF THE INVENTION

The present invention relates to an illuminated safety helmet to be worn by individuals engaging in activities, such as cycling, skating and working under conditions of limited lighting so that the individuals are readily visible.

Existing safety helmets include reflectors arranged in various locations on the helmet so that the illumination from lights of on-coming vehicles is reflected to alert motorists of the presence of the individual wearing the helmet.

However, the use of reflectors provides limited protection since the motorist is only alerted to the presence of the individual when the light from the vehicle impinges upon the reflectors on the helmet to generate reflected light. Accordingly, the vehicle is relatively close to the individual before being alerted to the individual's presence. Therefore, the current safety helmets provide limited visibility and protection.

SUMMARY OF THE INVENTION

It is an object of the present invention to provide an illuminated safety helmet where the illumination may be continuous or flashing.

It is a further object of the present invention to provide an illuminated safety helmet which is battery operated and requires a minimal amount of power.

The above-mentioned objects of the invention are accomplished by an illuminated safety helmet which includes a light-weight electroluminescent strip adhered to the helmet shell which is powered by a rechargeable battery.

BRIEF DESCRIPTION OF THE DRAWINGS

FIG. 1 is a perspective view of an illuminated safety helmet according to a first embodiment of the present invention as seen from the rear.

FIG. 2 is a perspective view of an illuminated safety helmet according to a first embodiment of the present invention as seen from the front.

FIG. 4 is a perspective view of an illuminated safety helmet according to a second embodiment of the present invention as seen from the left side.

FIG. 5 is a perspective view of an illuminated safety helmet according to a second embodiment of the present invention as seen from the right side.

DETAILED DESCRIPTION OF THE PREFERRED EMBODIMENT

The present invention will be described with reference to the accompanying drawings.

Figure 3:
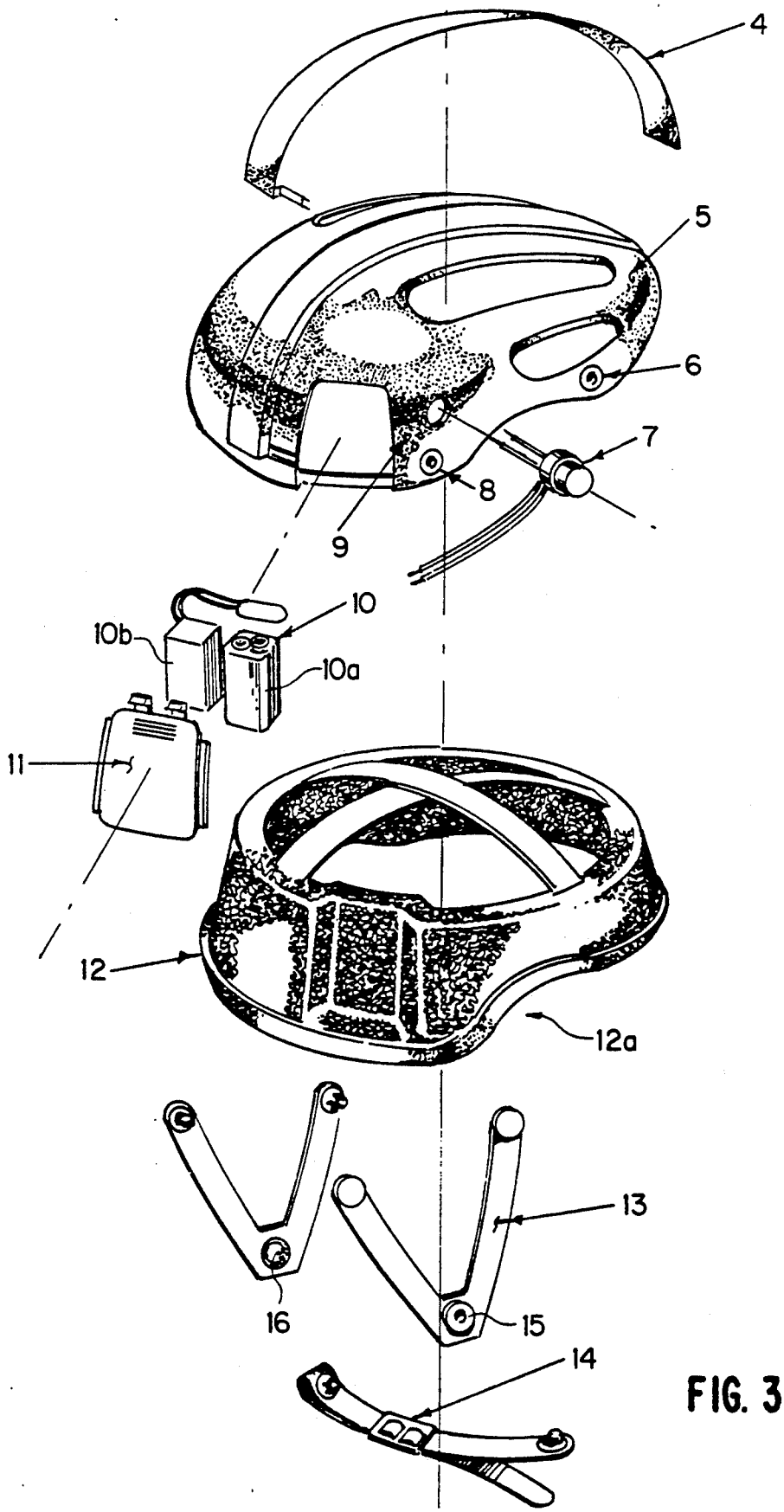
FIG. 3 is an illustration of a detailed arrangement of an illuminated safety helmet according to a first embodiment of the present invention.

FIG. 3 illustrates the detailed arrangement of the illuminated safety helmet according to a first embodiment of the present invention. The illuminated safety helmet illustrated in FIG. 3 can be used during athletic activities and includes a foam head protector with integral straps 12. A chin strap support 13 is secured to each side of the helmet shell 5 by grommets 6 and 8 (grommets 6 and 8 on the left side of the helmet are not shown). An adjustable chin strap 14 is supported by two grommets 15 and 16 respectively provided on the chin strap supports 13. The illuminated safety sports helmet is secured to the head by the chin strap supports 13 and the adjustable chin strap 14. An electroluminescent strip 4 is adhered to the helmet shell 5 which provides for the illumination of the helmet.

The electroluminescent strip 4 provides a compact and light-weight means for generating continuous or flashing illumination on the helmet. Other beneficial characteristics of the electroluminescent strip include low power consumption and minimal heat radiation.

The electroluminescent strip 4 is produced by embedding phosphors in a thin layer of a transparent insulator which is then placed between electrodes for conducting current. The illumination from the electroluminescent strip is highly visible, even through fog.

The electroluminescent strip 4 is powered by leads (not shown) from a power unit 10 which includes a rechargeable battery **10*a* and an inverter 10*b* for converting the DC signal from the battery to an AC signal. A compartment 12*a* is formed in the foam head protector 12 located under the helmet shell 5 on the rear right side for receiving the power unit 10. A battery access door 11 snaps into place when the power unit 10 is installed into the compartment 12*a*. The power unit 10 is controlled by an ON/OFF switch 7 located on the right rear of the helmet shell 5 near the compartment 12*a* for the power unit 10**.

A low voltage battery, such as a 9-volt battery, is sufficient to illuminate the electroluminescent strip 4. A recharge plug is inserted into a female plug 9 when the illuminated safety sports helmet is not in use to recharge the battery **10*a***.

An illuminated safety helmet according to a second embodiment of the present invention will be discussed with reference to FIG. 6.

Figure 6:
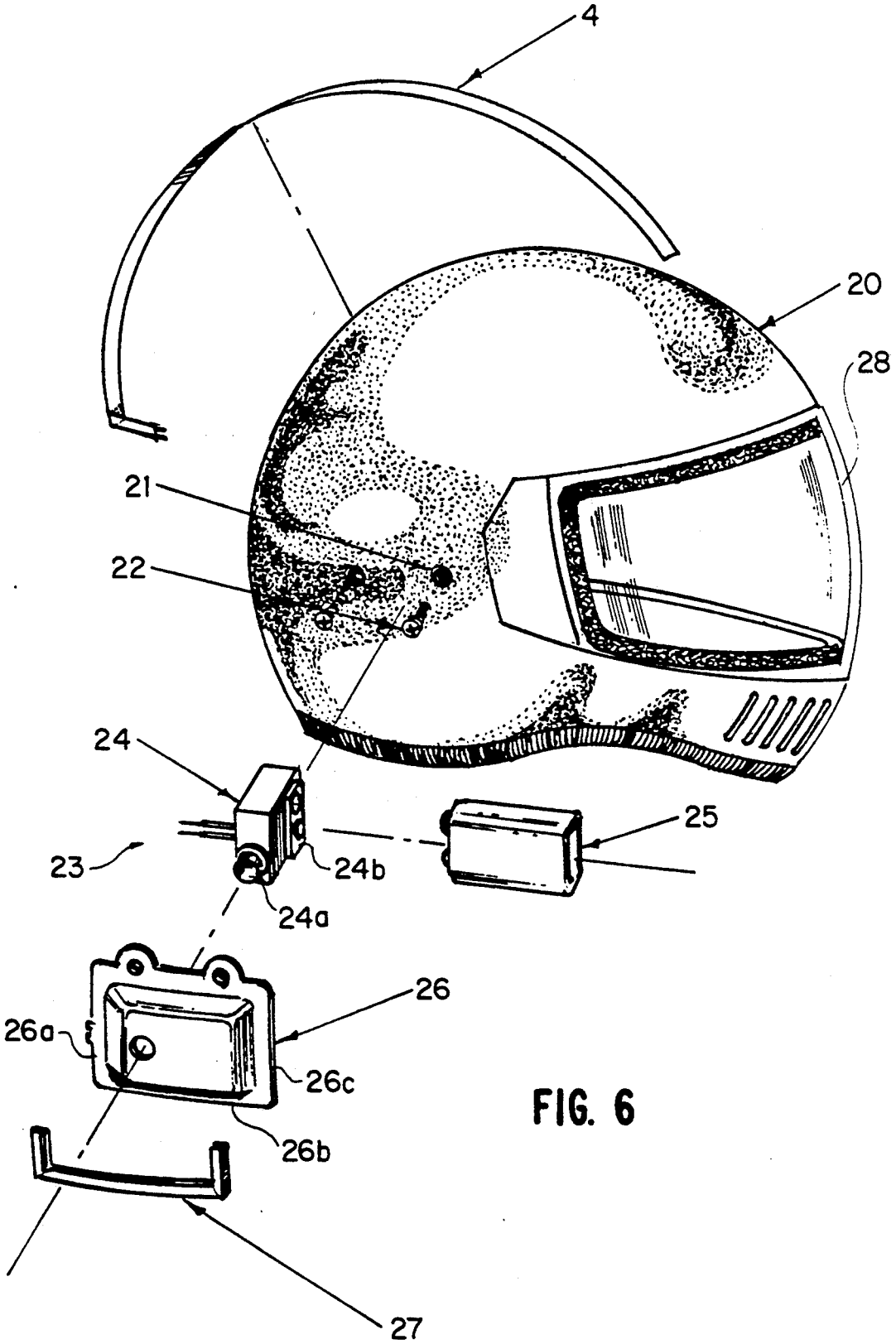
FIG. 6 is an illustration of a detailed arrangement of an illuminated safety helmet according to a second embodiment of the present invention.

The illuminated safety helmet illustrated in FIGS. 4–6 is designed for use in such activities as operating a motorcycle, snowmobile, machinery, etc. The safety helmet includes a helmet shell 20 which can be manufactured from any durable material, such as fiberglass. An electroluminescent strip 4 is adhered to the helmet shell 20 and provides for the illumination of the helmet.

The electroluminescent strip 4 is powered by leads (not shown) from a power unit 23 which includes a rechargeable battery 25 and an inverter 24 for converting a DC signal to an AC signal. The inverter 24 also includes an ON/OFF switch **24*a* and a battery clip 24*b*. The power unit 23 is arranged in a power unit cover 26 which is secured to the helmet shell 20 by screws 22 threaded into threaded inserts 21 formed on the helmet shell 20**.

The power unit cover 26 includes an opening **26*a* for receiving the ON/OFF switch 24*a* to provide access to the ON/OFF switch. The power unit cover 26 is further secured to the helmet shell 20 by a U-shaped extrusion 27 which is arranged on the helmet shell 20 by an adhesive and respectively receives the bottom and side flanges 26*b* and 26*c* of the power unit cover 26**.

The illuminated safety helmet according to the second embodiment is designed for greater protection by covering the entire head area and may further include a transparent shield 28 for protecting the face area, particularly the eyes, of the individual wearing the helmet.

The illuminated safety helmet according to the present invention includes an electroluminescent strip which is battery operated so that the individual wearing the helmet is highly visible from a distance. Since the illumination is generated by the power unit within the helmet, the individual can be seen before the illumination from the lights of a motor vehicle, or other object, are directed toward the helmet. Therefore, the illuminated safety helmet according to the present invention provides for a greater degree of visibility and protection than existing safety helmets.

While the invention has been described in detail and with reference to specific embodiments, it will be apparent to one skilled in the art that various modifications can be made without departing from the spirit and scope of the invention.

What is claimed is:

1. An illuminated safety helmet comprising:

a helmet shell;

at least one electroluminescent strip permanently adhered to said helmet shell; and a power unit for supplying power to said at least one electroluminescent strip, said power unit being arranged on said helmet shell;

wherein said power unit includes a rechargeable battery and an inverter for converting a DC signal from said rechargeable battery to an AC signal, and wherein said power unit further includes a battery access door;

said helmet shell including a foam protector; and wherein said foam protector includes a recessed pocket for receiving said power unit and said helmet shell includes an opening corresponding to said recessed pocket to provide access to said recessed pocket, and wherein said batter access door snaps into said opening to cover said power unit once said power unit is arranged within said recessed pocket.

* * * * *